United States Patent [19]

Fitsall

[11] 4,075,869

[45] Feb. 28, 1978

[54] COOLING OR FREEZING ARTICLES

[75] Inventor: Robert Alan Fitsall, Wallington, England

[73] Assignee: BOC International Limited, London, England

[21] Appl. No.: 652,743

[22] Filed: Jan. 27, 1976

[30] Foreign Application Priority Data

Feb. 10, 1975 United Kingdom ..... 05639/75

[51] Int. Cl.[2] ..... F25D 17/02

[52] U.S. Cl. ..... 62/374; 62/380

[58] Field of Search ..... 62/374, 375, 266, 380, 62/381, 63, 51, 54

[56] References Cited

U.S. PATENT DOCUMENTS

| | | | |
|---|---|---|---|
| 3,150,495 | 9/1964 | Reed | 62/54 |
| 3,427,820 | 2/1967 | Hart | 62/374 |
| 3,845,635 | 11/1974 | Perkins et al. | 62/51 |
| 3,892,104 | 7/1975 | Klee et al. | 62/374 |

*Primary Examiner*—Ronald C. Capossela
*Attorney, Agent, or Firm*—Dennison, Dennison, Meserole & Pollack

[57] ABSTRACT

An apparatus for cooling or freezing articles in which the articles are moved through a tunnel and are contacted successively by a vaporized cryogenic medium and liquid cryogenic medium. Jets of pressurized gas are introduced into the gas contacting zone to cause turbulence in flow of vaporized cryogenic medium through that zone.

11 Claims, 2 Drawing Figures

COOLING OR FREEZING ARTICLES

FIELD OF THE INVENTION

The present invention relates to a method and apparatus for cooling or freezing articles by contact with a cryogenic fluid.

BACKGROUND OF THE INVENTION

In cooling or freezing processes using a cryogenic fluid, such as liquid nitrogen, it is usual for the article or articles which are to be frozen to be advanced by a moving belt or other conveyor into and through a spray of the cryogenic liquid, which vaporises on the surface of the articles. The gas which is thereby produced, together with gas which has been generated by evaporation of the cryogenic liquid during its passage along the pipe between the cryogenic storage tank and the tunnel, contains residual cold which can be conveniently used to pre-cool the articles. Not only does such pre-cooling ensure efficient utilisation of the available cold, but it also reduces the risk of thermal shock which uncooled articles may suffer when contacted by the spray of cryogenic liquid. It is known to achieve this pre-cooling by enclosing the conveyor in a tunnel and arranging for the gas to flow through the tunnel counter-currently to the moving articles.

Heat exchange between a solid and fluid is enhanced if the fluid is kept in rapid motion with respect to the solid. To this end it is known to provide fans or blowers in the tunnel in order to agitate the cold gas, and it is also known that certain arrangements of fans are especially effective. Measurement of gas velocities in a tunnel equipped with agitating fans has shown that the degree of agitation imparted to the gas can vary markedly between different parts of the tunnel as a result of variations in the gas distribution patterns of the agitating fans. Measurement at intervals of the temperatures of articles being conveyed through such a tunnel has furthermore shown that those articles which pass through the more turbulent gas zones are subjected to more rapid cooling than those articles which pass through the less turbulent zones.

Another disadvantage of known arrangements incorporating agitating fans or blowers driven by electric motors, is that a heating effect is caused on the circulating gas. If the motors which drive the agitating fans are mounted inside the tunnel, the heating effect on the gas will arise from heat generated, for example by the dissipation of electrical energy, within the motors. If the motors are mounted externally, heat may flow from outside the tunnel through the gaps in the thermal insulation necessary to permit passage of the drive shafts or couplings. A further disadvantage is that the fans and motors, together with their associated fittings and electrical wiring and controls, constitute an expensive and complicated addition of the apparatus. Any breakdown in the construction or function of such fans or such motors or such associated fittings will cause the efficiency of the cooling or freezing apparatus to be reduced.

Furthermore, the cyrogenic liquid used is stored in a closed, thermally insulated container, and is transferred to the cooling or freezing apparatus through a thermally insulated pipe. During storage and transfer, heat is transmitted from the surroundings of the vessel and pipe through the thermal insulation to the cryogenic liquid by virtue of the temperature difference between the surroundings and the fluid. The effect of this is to raise the temperature of the liquid and consequently to cause an increase in the pressure of the gas above the liquid in the vessel; the vessel is provided with safety valves to limit such pressure increase to that which is safe for the vessel. The passage of the cryogenic liquid from the vessel to the spray nozzles is controlled by a throttling valve fitted in the pipe; on passage through the throttling valve, the cryogenic liquid experiences a reduction in pressure as a result of which a proportion of the liquid is caused to evaporate. This evaporation results in the formation of bubbles of vapour within the liquid, and the presence of such bubbles restricts the rate at which the liquid can be induced to flow through the spray nozzles. Furthermore, the extent of this restriction varies from time to time and from place to place, causing a variation both in the flow rate of the liquid and in the distribution of the liquid. As a consequence of such variations, difficulty is often experienced in maintaining accurate control over the flow of the cryogenic liquid. These effects are more marked in the case of a cryogenic liquid whose temperature has been raised by transmission of heat through the insulation of the storage vessel and/or the pipeline.

The invention provides a process for cooling or freezing articles which comprises moving the articles through a tunnel having therein a gas contacting zone and a liquid contacting zone, the articles being moved through the gas contacting zone before they are moved through the liquid contacting zone, supplying a vaporisable liquid cryogenic medium to the liquid contacting zone to contact articles, at the time being passing through that zone, creating a flow of the cryogenic medium, which is vaporised in the liquid contacting zone, through the gas contacting zone, and introducing jets of pressurized gas into the gas contacting zone so as to contact articles, at the time being, passing through that zone and to cause turbulence of the aforesaid flow of the vaporised cryogenic medium through the gas contacting zone.

The gas in the jets introduced into the gas contacting zone is preferably at a pressure of not less than 1 psig.

According to the feature of this invention, the gas in the jets may be the same as that of the vaporised cryogenic medium. If this feature is adopted, the cryogenic medium may be supplied from a vapor separating device, at least part of the vapour phase being used to provide gas to said gas jets and the liquid phase being supplied to liquid contacting zone. If this feature is adopted, the liquid phase may be supplied to the liquid contacting zone through a further vapour separating device to remove cryogenic medium vaporised in a connection between the first mentioned vapour separating device and the liquid separating zone.

According to another feature of this invention, at least some of the aforesaid jets of gas may be directed so as to impart a component of velocity of the vaporised cryogenic medium to assist the aforesaid flow thereof through the gas contacting zone. Additionally some of the jets may be directed to have a component of velocity opposing said flow to create additional turbulence of said flow.

At least one further jet of pressurized gas may be introduced into the tunnel between the liquid contacting zone and the outlet end of the tunnel in a direction so as to assist the aforesaid flow through the gas contacting zone of the cryogenic medium vaporised in the liquid contacting zone.

The invention also provides apparatus for cooling or freezing articles which apparatus comprises a tunnel having therein a gas contacting zone and a liquid contacting zone, conveyor means for moving articles through the tunnel so that the articles pass through the gas contacting zone before passing through the liquid contacting zone, supply means for supplying a vaporizable liquid cryogenic medium to the liquid contacting zone to contact, in use, articles passing through that zone, means for creating a flow of the vaporised cryogenic medium from the liquid contacting zone, through the gas contacting zone, a plurality of jets in the gas contacting zone, and connection means to connect the jets to a supply of pressurised gas, the jets being arranged so as to provide, in use, jets of pressurised gas directed to contact articles passing through the gas contacting zone and to cause turbulence of the aforesaid flow of the varporised cryogenic medium through the gas contacting zone.

According to the feature of the invention, a vapour separating device may be provided to receive the cryogenic medium, said connecting means connecting the vapour separating device to the jets to supply the jets in use with at least part of the vapour phase of the cryogenic medium, and said supply means being connected to the vapour separating device to supply the liquid phase of the cryogenic medium to the liquid contacting zone of the tunnel. In such constructions, said supply means may include a further vapour separating device to separate cryogenic medium vaporised in said supply means from liquid cryogenic medium to be fed to the liquid contacting zone.

According to another feature of the invention, control means may be provided for controlling the flow of gas supplied in use of the jets. Said control means may comprise an adjustable valve or restrictor in said connection means. In arrangements where a vapour separating device is provided, said control means may include a vaporising coil in the vapour separating device.

According to a further feature of the invention, at least one of the jets may be positioned so that in use it provides a jet of gas which imparts to the aforesaid flow of vapourised cyrogenic medium through the gas contacting zone a component of velocity which assists such flow. Additionally, at least one of the jets may be positioned so that in use it provides a jet of gas having a component of velocity opposing said flow of vaporised cryogenic medium.

According to another feature of the invention, at least one of the jets may be mounted so that its position can be altered to adjust the direction of the gas stream issuing in use from that jet at least between a direction towards the conveyor means and perpendicular to the longitudinal direction of the tunnel, and a direction towards the conveyor means but with a component towards the inlet end of the tunnel so that the gas stream is oblique to the longitudinal direction of the tunnel.

According to a feature of the invention, there may be provided at least one further jet in the tunnel between the liquid contacting zone and the tunnel outlet end and means to connect that jet to a supply of pressurized gas, the further jet being positioned to provide in use a stream of gas in a direction to assist flow of the aforesaid flow of vaporised cryogenic medium through the gas contacting zone.

An apparatus according to the invention may be provided in combination with a supply of gas under a pressure of at least 1 psig to which the aforesaid connecting means are connected to supply, in use, such gas to the jets.

DETAILED DESCRIPTION OF THE DRAWINGS

Figure 1:
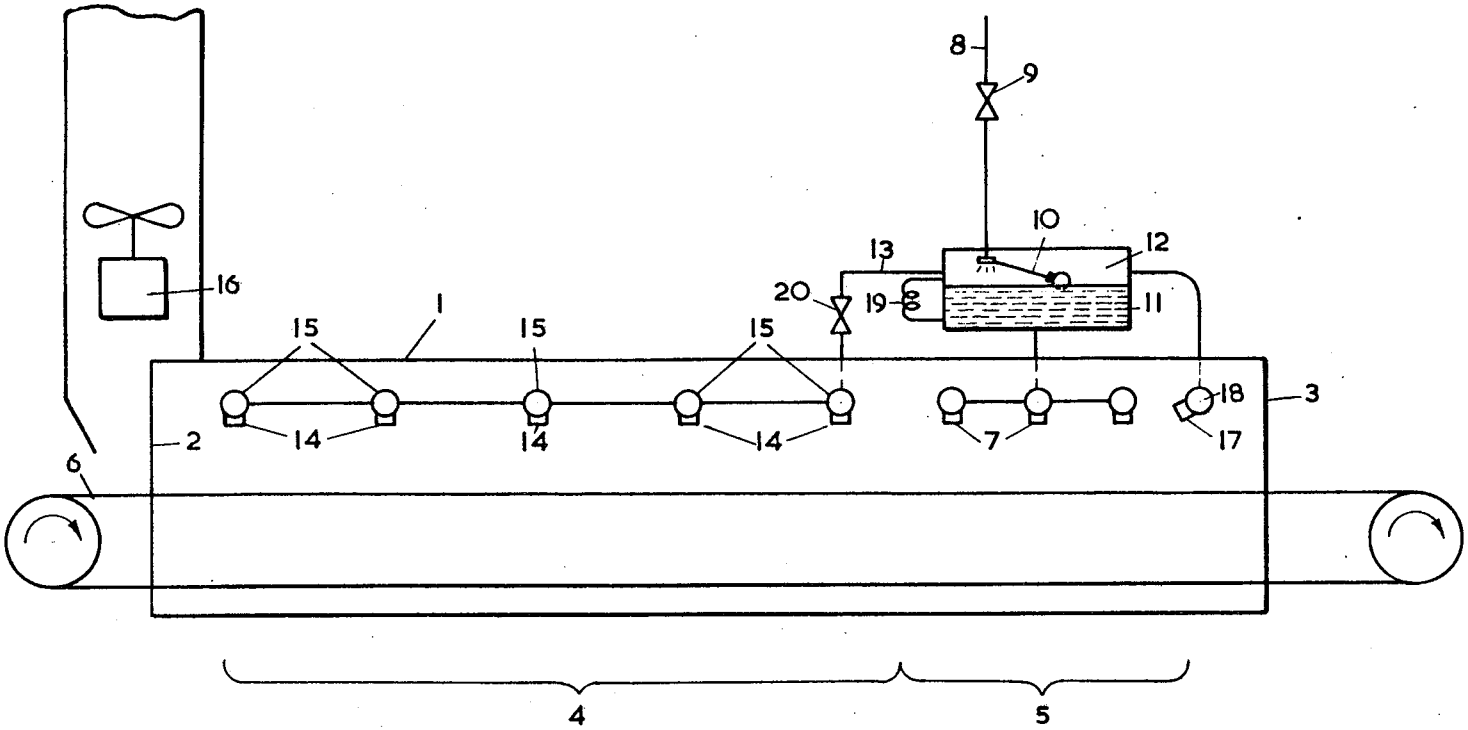
FIG. 1 is a diagrammatic illustration of an apparatus embodying the invention; and, FIG. 2 is a detail of the apparatus of FIG. 1

Referring to the drawings, the apparatus comprises an insulated tunnel 1 which has an inlet opening 2 and an outlet opening 3, and which defines a gas contacting zone 4 and a liquid contacting zone 5. A conveyor 6 is provided for advancing articles such as foodstuffs through the tunnel from the inlet 2 to the outlet 3. A system of spray jets 7 is provided in the liquid contacting zone 5 for spraying the articles with a cryogenic liquid such as liquid nitrogen to effect their cooling or freezing. The cryogenic liquid contained in a storage vessel (not shown) is supplied from a transfer pipe 8 equipped with an adjustable control valve 9 to a vapour separating device 10, in which the cryogenic liquid 11 is separated from the vapour 12 which is formed as a result of the ingress of atmospheric heat into the storage vessel and the line 8 and also as a result of the diminution in pressure of the cryogenic liquid following its passage through the valve 9. The valve 9 may be manually or automatically operated.

The separated gas is allowed to pass through a pipe 13 to an arrangement of gas jets 14 mounted on transverse header pipes 15. On passage through the jets the emerging gas streams impinge upon the conveyor or articles placed on it, and in so doing create turbulence within the gas contacting zone 4 of the additional gas which is released in the liquid contacting zone 5 and which is drawn into the gas contacting zone 4 by the action of an exhaust fan 16 and as a result of any horizontal component of velocity which may be imparted to the gas by virtue of the angle of the gas or liquid jets. There are also provided gas jets 17 on a further transverse header pipe 18 in a zone between the liquid contacting zone 5 and the outlet 3. The gas issuing from jets 17 has a component of velocity towards the inlet end of the tunnel to assist flow of the cryogenic liquid vaporised in zone 5 through the gas contacting zone 4 and to discourage egress of the vapour to the outlet end of the tunnel.

Figure 2:
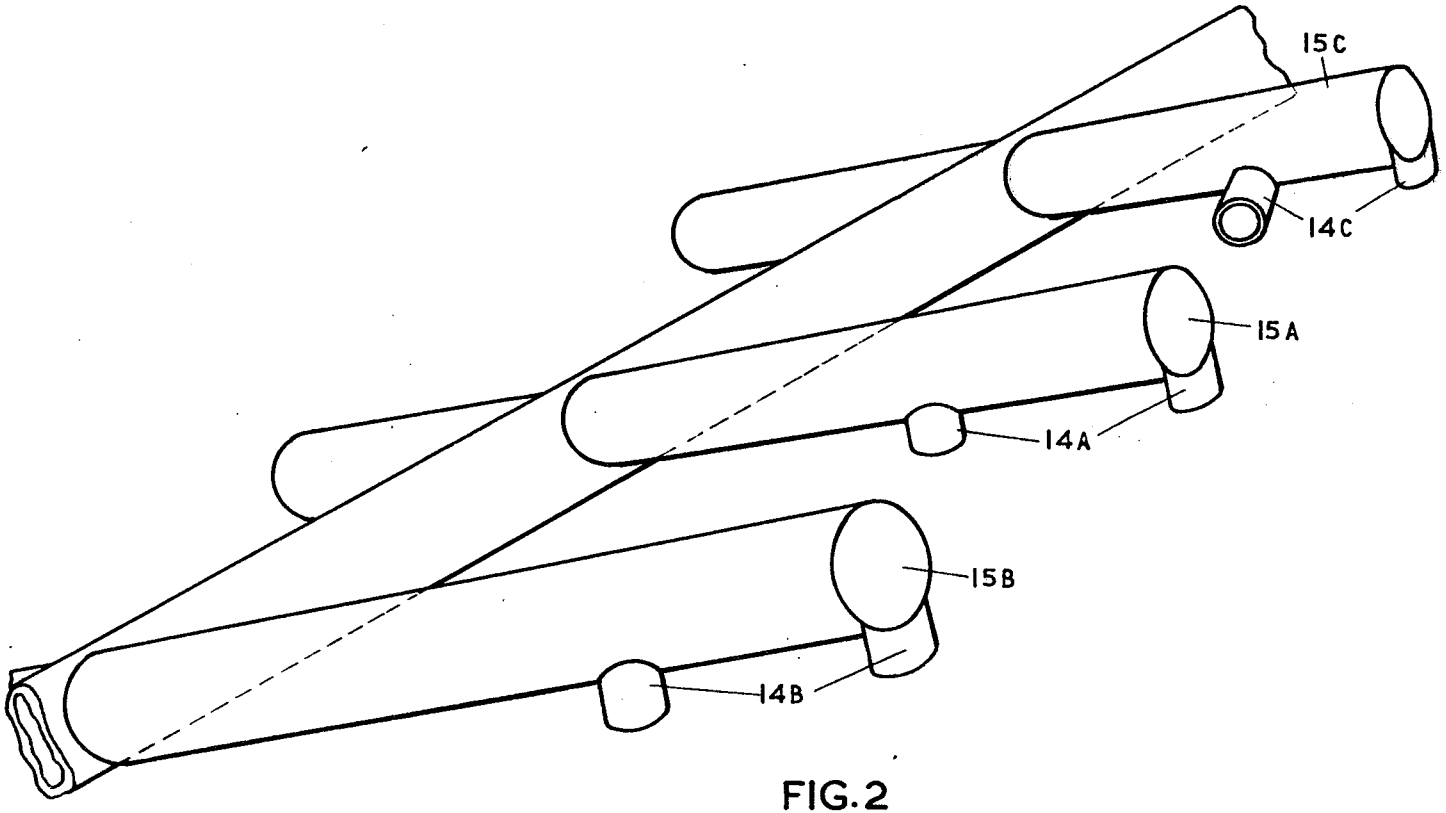

The manner of adjustment of the angle of three banks of gas jets in the gas contacting zone 4 will now be described with reference to FIG. 2, in which there is shown gas jets 144 on header pipe 15A, the jets being adjusted to provide emergent gas streams in a vertically downward direction perpendicular to the longitudinal direction of the tunnel. Gas jets 14B and 14C on header pipes 15B and 15C respectively are directed of velocity respectively similar to and opposite to the to provide emergent gas streams with a horizontal component of velocity respectively similar to and opposite to the direction of movement of the conveyor. Gas jets 14C assist the flow of cryogenic medium vaporised in zone 5 through zone 4 whereas jets 14B create additional overall turbulence in said flow as well as creating turbulence around the trailing edge of articles moving through zone 4. Usually a majority of jets directed towards the inlet end of the tunnel will be provided with a minority of jets directed towards the outlet end of the tunnel. The gas jets may be movably mounted so that the direction of the emergent gas streams can be altered to achieve different amounts of turbulence while the flow of cryogenic medium, which is vaporised in zone 5, through zone 4 remains assisted by the gas flow from jets 14.

It is possible in such an apparatus, to provide means for increasing or decreasing the amount of gas supplied to the jets in the gas contacting zone. Such an increase in the amount of gas is provided by means of a vaporising coil 19 fitted to the gas separator 11 or it could be located in any part of the liquid transfer pipe, and such a decrease is provided by means of an adjustable valve or restrictor 20 fitted between the gas separator 11 and the jets 14 in the gas contacting zone. It is also possible to supply gas to the jets in the gas contacting zone from above the surface of the liquid in the cryogenic storage vessel. The amount of such gas from the cryogenic vessel may be increased by use of a vaporising coil such as is normally fitted to a cryogenic vessel and may be decreased by means of an adjustable valve or restrictor fitted between the vessel and the jets in the gas contacting zone. In such an embodiment it would be possible to omit vapour separator 11. It is however preferred that the separator 11 would not be omitted in such constructions since it ensures a flow of cryogenic liquid uncontaminated with vapour to the jets 7. The vapour 12 from the separator 11 could still be usefully used to supply the gas jets 17.

It will be appreciated that in other embodiments of the invention pressurised gas could be supplied to the jets 14 from a source separate from that of the liquid cryogenic medium supplied to jets 7. It is preferred that the gas supplied to the jets 14 is under a pressure of not less than 1 psig.

An advantage of the above described embodiment is that the turbulence created by the jets of gas from jets 14 in the flow of vapourised cryogenic liquid lessens the temperature differences between articles passing through different zones of the tunnel. Furthermore, since there are no electrically driven fans in the gas contacting zone heating effects due to the presence of such devices should be reduced. Also breakdowns due to use of such additional apparatus are obviated.

Another advantage of the above described apparatus is that by using a vapour separator, the likelihood of variations in the flow rate of cryogenic liquid to jets 17 is reduced thereby assisting in the accuracy of control of the flow rate of the cryogenic liquid.

What is claimed is:

1. Apparatus for cooling articles, which apparatus comprises a tunnel having an inlet end an and outlet end, a gas contacting zone and a liquid contacting zone within said tunnel, conveyor means for moving articles through the tunnel from said inlet to said outlet, said articles passing through the gas contacting zone before passing through the liquid contacting zone, supply means for supplying a vaporisable cryogenic medium initially in the liquid state to the liquid contacting zone to contact said articles passing through that zone and simultaneously vaporising a portion of said medium, gas discharge means in said gas contacting zone for creating a flow of the vaporised portion of said cryogenic medium from the liquid contacting zone through the gas contacting zone, said gas discharge means including a plurality of jets in the gas contacting zone, means connecting the to a supply of pressurised gas, said jets being configured to direct said pressurised gas into contact with said articles passing through said gas contacting zone and to cause turbulence of the said flow of the vaporised portion of the cryogenic medium passing through the gas contacting zone.

2. Apparatus as claimed in claim 1 wherein a separating device is provided to receive the cryogenic medium from said supply, said separating device connecting the vaporised portion of said medium to the jets to supply the jets with at least part of the vapour phase of the cryogenic medium, and connecting the liquid portion of the cryogenic medium to the liquid contacting zone of the tunnel.

3. Apparatus as claimed in claim 2 wherein said supply means includes a further vapour separating device to separate cryogenic medium vaporised in said supply means from liquid cryogenic medium to be fed into the liquid contacting zone.

4. Apparatus as claimed in claim 2 wherein control means are provided for controlling the flow of pressurised gas supplied in use to the jets.

5. Apparatus as claimed in claim 4 wherein said control means comprise an adjustable restrictor in said connection means.

6. Apparatus as claimed in claim 4 wherein said control means includes a vaporising coil in the vapour separating device.

7. Apparatus as claimed in claim 1 wherein at least one of the jets is positioned to direct a jet of gas to impart to the aforesaid flow of vaporised cryogenic medium through the gas contacting zone a component of velocity which assists such flow.

8. Apparatus as defined in claim 7 wherein at least one of the jets is positioned to provide a jet of gas having a component of velocity opposing said flow of vaporised cryogenic medium.

9. Apparatus as claimed in claim 1 wherein at least one of the jets is adjustably mounted to control the direction of a gas stream issuing in use from that jet at least between a direction towards the conveyor means and perpendicular to the longitudinal direction of the tunnel, and a direction towards the conveyor means but with a component towards the inlet end of the tunnel so that the gas stream is oblique to the longitudinal direction of the tunnel.

10. Apparatus as claimed in claim 1 wherein there is provided at least one further jet in the tunnel between the liquid contacting zone and the tunnel outlet end and means to connect that yet to a supply of pressurised gas, the further jet being positioned to provide in use a stream of gas in a direction to assist flow of the aforesaid flow of vaporised cryogenic medium through the gas contacting zone.

11. Apparatus as claimed in claim 1 in combination with a supply of gas under a pressure of at least 1 psig to which the aforesaid jet connecting means are connected to supply such gas to the jets.

* * * * *